US010071897B2

(12) United States Patent
Meinzinger et al.

(10) Patent No.: US 10,071,897 B2
(45) Date of Patent: Sep. 11, 2018

(54) TAP SYSTEM HAVING CONTROLLED LIQUID OUTPUT

(71) Applicant: KRONES AG, Neutraubling (DE)

(72) Inventors: Rupert Meinzinger, Kirchroth (DE); Michael Neubauer, Uebersee (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/380,840

(22) PCT Filed: Feb. 25, 2013

(86) PCT No.: PCT/EP2013/053725
§ 371 (c)(1),
(2) Date: Aug. 25, 2014

(87) PCT Pub. No.: WO2013/124485
PCT Pub. Date: Aug. 29, 2013

(65) Prior Publication Data

US 2015/0053716 A1 Feb. 26, 2015

(30) Foreign Application Priority Data

Feb. 24, 2012 (DE) ..... 10 2012 101 507

(51) Int. Cl.
*B67D 7/06* (2010.01)
*B67D 7/56* (2010.01)
(Continued)

(52) U.S. Cl.
CPC ..... *B67D 1/0001* (2013.01); *B67D 1/0004* (2013.01); *B67D 1/0878* (2013.01);
(Continued)

(58) Field of Classification Search
CPC .. B67D 1/0001; B67D 1/0004; B67D 1/0878; B67D 1/0882; B67D 1/0884; B67D 1/12;
(Continued)

(56) References Cited

U.S. PATENT DOCUMENTS 4,456,134 A 6/1984 Cooper ..... 215/12 R
5,139,169 A 8/1992 Boyer ..... 222/103
(Continued)

FOREIGN PATENT DOCUMENTS

DE 2 323 762 11/1974 ..... A01G 25/16
DE 200 01 409 4/2000 ..... B67D 1/00
(Continued)

OTHER PUBLICATIONS

International Search Report and Written Opinion issued in corresponding PCT Patent Appln. No. PCT/EP2013/053725 dated Jul. 2, 2013 (11 pgs).

*Primary Examiner* — Jeremy W Carroll
(74) *Attorney, Agent, or Firm* — Hayes Soloway P.C.

(57) ABSTRACT

A apparatus for discharging liquids from deformable containers includes a first holding device for holding a first portion of the container, and a second holding device for holding a second portion of the container, wherein the second portion of the container is spaced from the first portion of the container and wherein the holding devices are arranged such that the container can be arranged at least in sections between the holding devices, and is deformable by a relative movement of one holding device with respect to the other holding device.

12 Claims, 6 Drawing Sheets

(51) Int. Cl.
*B67D 1/00* (2006.01)
*B67D 3/00* (2006.01)
*B67D 1/08* (2006.01)
*B67D 1/12* (2006.01)

(52) U.S. Cl.
CPC ..... *B67D 1/0882* (2013.01); *B67D 1/0884* (2013.01); *B67D 1/12* (2013.01); *B67D 1/125* (2013.01); *B67D 3/0006* (2013.01); *B67D 2001/0811* (2013.01)

(58) Field of Classification Search
CPC ..... B67D 1/125; B67D 3/0006; B67D 2001/0811
USPC ..... 222/23, 95
See application file for complete search history.

(56) References Cited

U.S. PATENT DOCUMENTS 5,176,280 A * 1/1993 Robbins, III ..... A47J 45/075 215/395
5,183,169 A * 2/1993 Grzych ..... B65D 23/106 215/395
5,206,037 A * 4/1993 Robbins, III ..... B29C 53/08 264/295
5,224,613 A * 7/1993 Robbins, III ..... B29C 53/08 215/10
5,413,231 A * 5/1995 Carroll ..... B65D 23/106 215/396
5,505,336 A * 4/1996 Montgomery ..... B67D 1/0001 222/326
5,553,740 A * 9/1996 King ..... B67D 1/0001 222/1
5,893,485 A * 4/1999 McGill ..... A23G 3/02 100/125
6,003,205 A * 12/1999 Dehaven ..... B65D 23/106 16/422
7,726,499 B2 * 6/2010 Williamson ..... A47G 23/0241 215/396
2003/0102333 A1 * 6/2003 Wright ..... B65D 77/067 222/340
2006/0054641 A1 * 3/2006 Evers ..... B67D 1/0001 222/326
2008/0156442 A1 * 7/2008 Meinzinger ..... B65C 9/0062 156/351
2012/0104020 A1 * 5/2012 Cur ..... B67D 1/0001 222/1

FOREIGN PATENT DOCUMENTS

DE 102 34 412 2/2004 ..... B67D 7/02
DE 10 2007 054 431 5/2009 ..... B67D 3/00
EP 0 250 640 9/1986 ..... B67D 1/00
GB 2 178 001 2/1987 ..... B65D 25/38
GB 2178001 A * 2/1987 ..... B67D 1/0001
WO WO 94/03376 2/1994 ..... B65D 77/06

* cited by examiner

Fig. 9e
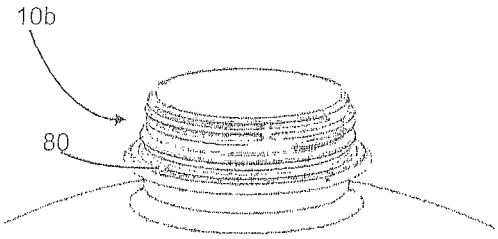
Fig. 9f
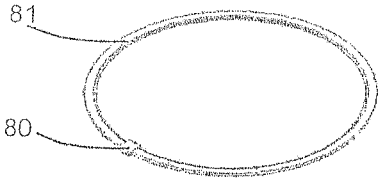
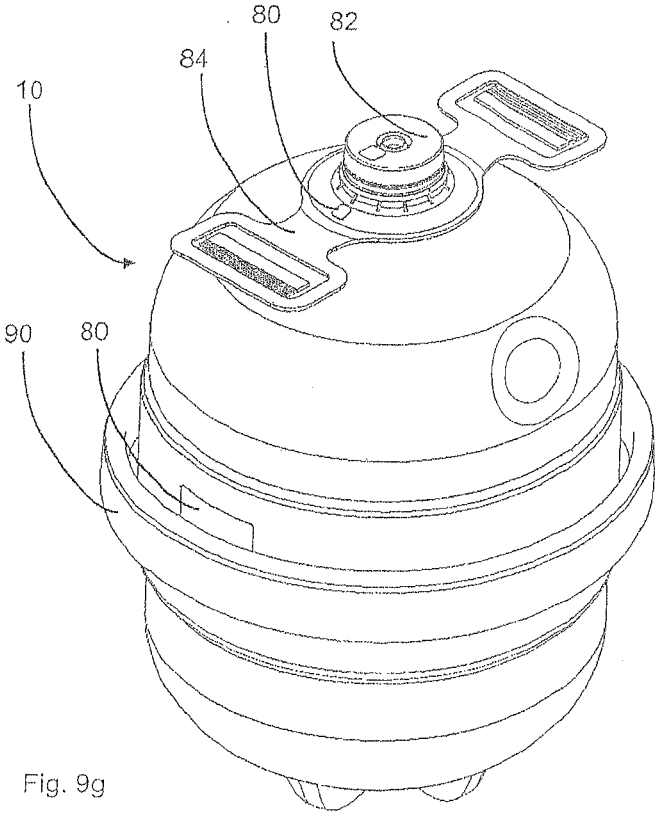
Fig. 9g

TAP SYSTEM HAVING CONTROLLED LIQUID OUTPUT

BACKGROUND OF THE INVENTION

The present invention relates to a device and a method for discharging liquids from deformable containers, for example plastics material containers. The present invention is disclosed with reference to what is known as a tap system, which may be made use of in particular in taprooms. However, private use may also be made of tap systems of this type. Aside from plastics material containers, containers made of other materials (for example of aluminum) may also be used, but in particular those containers of which the material can be deformed/reshaped without tearing. In the following, however, the term "plastics material container" is used as representative of other containers too.

It is further noted that the present invention is suitable in particular for low-viscosity liquids, such as waters, beers, soft drinks and the like. However, the invention could equally well be applied to media having a higher viscosity, such as oils, ketchup, soaps or the like.

A wide range of devices for discharging liquids from containers are known from the prior art.

Thus for example DE 10 2007 054 431 A1 discloses a device for discharging liquids from a container. In this context, a deformation element is used which deforms the container, this deformation element in this case folding the container to be emptied and in this way making it possible to discharge the liquid virtually completely from the container. The disclosure of DE 10 2007 054 431 A1 is hereby incorporated in its entirety into the disclosure of the present invention.

The object of the present invention is to improve output devices of this type for liquids and in particular for drinks in terms of the handling thereof. Thus, the use of systems of this type can be simplified, in particular for use in dispensing systems or in pubs or taprooms.

Further, the safety of handling systems of this type is to be improved, and in particular tearing or cracking of the container during discharging is to be prevented.

SUMMARY OF THE INVENTION

A device according to the invention for discharging liquids from deformable containers (in particular deformable without destruction or tearing) comprises a first holding means, which is suitable for holding a first portion of the container. The device further comprises a second holding means which is suitable for holding a second portion of the container. In this context, in an initial state of the container—in other words in particular a completely filled state of the container—said second portion of the container is spaced from the first portion of the container.

Further, the holding means are arranged in such a way that the container can be arranged at least in sections between these holding means, and thus is deformable by a relative movement of one holding means with respect to the other holding means. Further, a drive means is provided for producing a relative movement between the first holding means and the second holding means, so as to deform the container arranged between these holding means in such a way that the internal volume thereof is reduced.

The device further comprises a discharging means, which comprises a flow connection to the interior of the container and in particular to the liquid located therein, and through which the liquid can be discharged by compressing the container.

According to the invention, the device comprises a control means which controls the relative movement of one holding means with respect to the other holding means or the discharging of the liquid through the discharging means as a function (at least indirectly) of an internal pressure within the container. The method according to the invention extends in particular the subject matter of the aforementioned application DE 10 2007 054431 as regards the manner and direction in which the container is deformed, and in particular as regards the manner in which the emptying of the container is controlled. The twit "as a function, at least indirectly" means that control is possible as a direct function of the internal pressure, but also as an indirect function (for example as a function of a drive torque of the drive means, which depends on the internal pressure in the container, or as a function of the pressure of the liquid in the discharging means).

The drive means may in particular be an electric motor which controls the relative movement of the holding means with respect to one another for example via a spindle drive. Advantageously, the drive means therefore also comprises a transmission means which converts a drive speed of the drive motor into a lower movement speed.

Alternatively, however, it would also be conceivable to use hydraulic or pneumatic drives to move the holding means with respect to one another. It is advantageous for the holding means to move in a straight line with respect to one another, and in particular in a longitudinal direction of the container. In this context, it would be possible for one holding means to be arranged stationary and for the other one to move with respect thereto. However, it would also be possible for both holding means to be moved.

In a further advantageous embodiment, a carrier is provided on which at least one holding means is arranged. It is advantageous for the other holding means also to be arranged on a corresponding carrier.

In a further advantageous embodiment, one holding means extends in the longitudinal direction of the container and is preferably of a length corresponding to at least a third of the total length of the container. This embodiment has the advantage of being particularly compact.

In a further advantageous embodiment, the first holding means serves to hold a base area of the container. For this purpose, the first holding means may for example comprise a recess into which a base area of the container can be introduced. In this context, it would be possible for the holding means to be adapted to the shape of the base of the container. However, it would also be possible for this holding means for example to be hemispherical or to be formed in some other manner. It is advantageous for the device according to the invention to be formed in such a way that it is suitable for discharging liquid from conventional commercial containers. In particular, in this context the device is also formed in such a way that it is suitable for discharging liquids from containers which comprise standard closures, such as plastics material screw closures.

In a further advantageous embodiment, the second holding means is used for holding an opening region of the container. In this context, it would be possible for the geometrical shape of the inner surface of the first holding means to be adapted to an outer surface of the container. In this case, for sufficiently strong drives, the container can be compressed so hard that virtually the entirety of the liquid can be discharged from the container. Unlike in the device disclosed in DE 10 2007 054431 A1, in which a special container is used, this is also possible for containers which have bases of different shapes, such as bases conventional in PET bottles, for example petaloid bases. It is advantageous for the second holding means to comprise a recess for receiving a closure of the container.

The control means according to the invention causes the compression of the container to be maintained at a particular maximum pressure for example. In this way, on the one hand the risk of cracking the container can be eliminated, and on the other hand liquid can be prevented from being withdrawn or discharged at an excessively high pressure. Various possibilities are conceivable for these control means and are described in detail below.

As stated above, in this context the device for discharging liquid can be implemented using relatively simple means. For example, the PET container can be compressed using threaded spindles and an electric drive, in such a way that the container can be reduced to a very small volume, so as to empty the container to a very small residual volume. It is advantageous for the container to be of a size of between 2 and 10 litres, or between 10 and 30 litres in a commercial application.

In a further advantageous embodiment, the first holding means and the second holding means are arranged in such a way that the container can be arranged standing with the opening thereof pointing upwards between them. In this way, liquid can be prevented from flowing out when this is not intended, for example if there is a fault in the discharging system.

In a further advantageous embodiment, the first holding means comprises a stamp element which is of a smaller cross-section than a base body of the container. In this way, the container can be folded in such a way that the internal volume thereof is reduced as much as possible. This is explained in the aforementioned DE 10 2007 054431 A1.

In a further advantageous embodiment, in an initial state a distance space between the first holding means and the second holding means can be changed so as to make adaptation to different containers possible. It would also be possible for the holding means to be exchangeable or for adapter elements to be provided which make adaptation to different containers possible.

It is advantageous for at least a portion between the two holding means to be formed without a housing. This means that at least a portion of the container to be compressed is not enclosed by a directly touching housing during the compression process. A directly enclosing housing of this type would disturb the movements of the holding means. Whilst in the prior art housings which support the containers during emptying are provided in many discharging devices, the Applicant has found that housings of this type, which are touched directly by the container, are not absolutely necessary.

In a further advantageous embodiment, the control means comprises a switching means, which switches the drive means on or off as a reaction to an internal pressure within the container. This may for example be a mechanical switch. It is thus possible to correct the container pressure when discharging liquid. It would thus for example be possible to apply the compressive force via compression springs and/or readjust it using a two-point control system. This is explained more precisely with reference to the drawings. It would also be possible to remove the pressure largely or even completely for the remaining emptying.

The switching means may be a mechanical switching element. However, an electronic switch, which for example reacts to a measured pressure, would also be possible. It is advantageous for at least one holding means to be spring-mounted, and particularly preferably connected to the switching means.

In a further advantageous embodiment, the discharging means comprises at least one flexible line portion. It is advantageous to arrange a flow-altering element, such as a compression element which can reduce the line cross-section, on this flexible line portion.

In a further advantageous embodiment, a pressure sensor element is provided and establishes an internal pressure in the container, and the control means controls the drive means as a function of values outputted by this pressure sensor element. Alternatively, the control may also be provided using a temperature sensor element.

In a further advantageous embodiment, it would also be possible for the pressure to be determined indirectly via a drive torque of the drive means and for the drive means to be switched off if a particular boundary drive torque is exceeded.

In a further advantageous embodiment, the device comprises an actuable valve for discharging the liquid. Thus for example the device may comprise an outlet which is for example manually actuable so as to discharge the liquid from the container. Discharging in this manner also changes the internal pressure in the container, and the drive means may in particular continue with the compression of the container.

In a further advantageous embodiment, a stamp movement or a relative movement of the two holding means towards one another increases the pressure in the container, and the amount discharged/withdrawn can be specified by way of the increase in pressure. In a further advantageous embodiment, a pressure regulation valve may also be provided for this purpose. This pressure regulation valve may advantageously be a combination of a cut-off valve, a pressure controller and a diffuser. In a further embodiment, the emission of the liquid is advantageously controlled by switching the drive means on and off. Switching on the drive means increases the internal pressure in the container, and thus also the pressure of the liquid in the discharging means. As a result of this increasing pressure, a discharging valve can open and liquid can thus be discharged. In this context, this discharging valve may be controlled in such a way in all cases the container is prevented from cracking as a result of overpressure.

The aforementioned flexible line means can be squeezed tight for cutting off and be opened for discharging the liquid, in particular only opened far enough that the container pressure is reduced to a desired flow speed by way of a small opening. Further, it is also possible for a tube cross-section to be expanded starting from a throttle cross-section in the length and shape of a diffuser.

In a further advantageous embodiment, the flexible line element or the tube may advantageously be squeezed until the escape during the closing process, so as thus also to be able to push out residual liquid. This serves for example as an expulsion aid.

In a further advantageous embodiment, the device comprises a movement element which moves the container with respect to a holding means. This movement element is in particular a movement element which moves the container with respect to a holding means, in particular a holding means which penetrates into the container (in FIG. 1 below, this is the upper holding means) when the two holding means move apart. In this way, the container can be pulled off at least in part, in such a way that the container can be removed from the holding means more easily. If a holding means is of a smaller cross-section than the base body of the container, this holding means penetrates into this body when the container is emptied. So as not to have to remove the container from this holding means entirely manually afterwards, it is therefore proposed to use in particular a rearward movement of the holding means or a movement apart of the two holding means so as to pull the container off from the holding means.

In a further advantageous embodiment, the holding means is formed in such a way that it can receive an opening region of the container. For this purpose, the holding means may itself comprise a recess which is formed to receive the opening region of the container.

In a further advantageous embodiment, the discharging means comprises a piercing means for piercing through at least a wall of the container or a container closure of the container. In particular, a piercing means is provided for piercing through the container closure. This can also make it possible to discharge liquids from standard containers. Thus for example this piercing means may be in the form of a tubular body comprising a cutting edge. In this embodiment, on the one hand liquid can be discharged from the container, but on the other hand the piercing means or the discharging means can preferably also be sealed off from the container during the discharging.

In a further advantageous embodiment, the discharging means is integrated into one of the two holding means. In particular, the discharging means is integrated into the holding means which is provided for receiving the opening region of the container. In this context, the discharging means may be arranged on or particularly preferably inside this holding means. In this way, a particularly central cavity, in which said piercing means and in particular also a pipeline are arranged, may be formed in the holding means.

In a further preferred embodiment, the holding means which is used for holding the opening region of the container comprises a stamp element which is of a smaller cross-section than a base body of the container. In this way, when the container is compressed, the opening portion of the container can be inserted into the portion of the container adjacent to the container base area. In this way, when the container is compressed, the opening region is positioned in a volume formed in the interior of a volume formed by a peripheral wall of the container.

The present invention further relates to a system comprising at least two devices of the type disclosed above and a mixing means in which the liquids from the two discharging means of the two devices can be mixed. In this way, different liquid components can be mixed together, in particular in post-mix operation.

In this way, it would be possible for the two discharging means to open into a mixing space, where they would be mixed together to form a liquid mixture. In this context, the respective mixing ratios may be controlled by actuating the two devices. It would also be possible for the two discharging means merely to open into one shared collecting line, which subsequently forms said mixing means. Further, it would also be possible for the liquids from the two discharging means to be metered into a shared collection line or a mixing space with a time offset.

In a further advantageous embodiment, the device comprises at least one readout means for reading out, in particular wirelessly, at least one identification element attached to the container. In particular, this may be a device for reading out an RFID element arranged on the container. In this way, the container to be emptied can be definitively identified. In a further advantageous embodiment, the device comprises a control means which also controls a discharging process as a function of a readout result of the readout means. Thus, the user can for example be informed by means of an alarm that he is using an unsuitable container for the discharging process. A discharging process can also be interrupted or prevented from starting as a reaction to a readout result of this type.

It is also conceivable for the control means to interrupt or not introduce a discharging process if it establishes that no marking element is provided on the container.

The present invention further relates to a method for discharging liquids from a container, wherein a container is arranged with a first portion (of the container) on a first holding means and with a second portion (of the container), spaced from the first portion, on a second holding means in such a way that the container is arranged at least in sections between this first holding means and the second holding means. Further, one holding means is moved towards the other holding means so as to deform the container and so as thus to reduce the internal volume of the container. In this context, liquid is discharged from the container using a discharging means (in particular while the container is compressed).

According to the invention, the movement of the first holding means with respect to the second holding means or the discharging of the liquid is controlled by means of the discharging means as a function of an internal pressure of the container.

Advantageously, the container is arranged upright with the opening thereof upwards between the holding means.

In an advantageous method, at least one holding means is substantially stationary. It is advantageous for the upper holding means, which holds the opening region of the container, to be substantially stationary and for the lower holding means to be moved with respect to the upper holding means. It is advantageous for the discharging means to be stationary in the movement direction of the holding means.

However, it would also be possible and preferred for the second holding means to be arranged movably with respect to the discharging means and in particular with respect to a piercing means. In particular, in this context, the second holding means is movable in a longitudinal direction of the container, and particularly preferably the second holding means is movable between two predetermined end positions. It would also be conceivable for the second holding means still to be movable, but also to be able to be locked in a predetermined position with respect to the discharging means or the piercing means in the longitudinal direction of the container or the movement direction of the holding means. This may be particularly advantageous for introducing a new, filled container.

In a further advantageous method, a portion of the container which contains the opening portion of the container is inserted into a portion of the container which contains the base area of the container. In the method disclosed herein, it would be possible either to insert the opening region of the container into the base area of the container or conversely to insert the base area of the container into the opening region. However, the mode of operation in which the opening region is inserted into the base area has the advantage that the opening of the container can be inserted into the base area or into an adjacent wall region. In this way, the volume of the compressed container can be further reduced.

Thus, the holding means which supports the base area of the container is preferably of a larger cross-section than the holding means which receives the opening region of the container.

It is advantageous for an identification element, in particular one which can be read contactlessly, by means of which at least one piece of information characteristic of the container can be read out, to be arranged in a region of the container. This is preferably an RFID element such as in particular but not exclusively an RFID chip.

It is advantageous for the identification element to be inseparably connected to the container. It is advantageous for the information to be selected from a group of pieces of information which includes an expiry date, information about the type of drink or the like.

In this way it could for example be ensured that containers for which the expiry date has passed are no longer emptied. Given knowledge as to the type of drink, relevant parameters for discharging can for example be controlled, such as an appropriate pressure.

In a preferred embodiment, the identification element is arranged on the container in the form of a label. Alternatively, it would also be possible for the identification element to be integrated into a region of the container, for example a wall region.

Alternatively, it is possible for the identification element already to be integrated into the containers during the manufacture thereof. It would thus be conceivable for the identification element already to be held ready in a region of a blow-moulding machine, for example inside a wall of a blow mould, during a production process for the container, in particular during a blow-moulding process, and to be fixed to the container on the wall of the container during the shaping process.

BRIEF DESCRIPTION OF THE DRAWINGS

Further advantages and embodiments can be taken from the attached drawings.

In the drawings:

FIGS. 9*a*-9*g* are drawings of a container comprising identification elements.

DETAILED DESCRIPTION OF THE INVENTION

Figure 1:
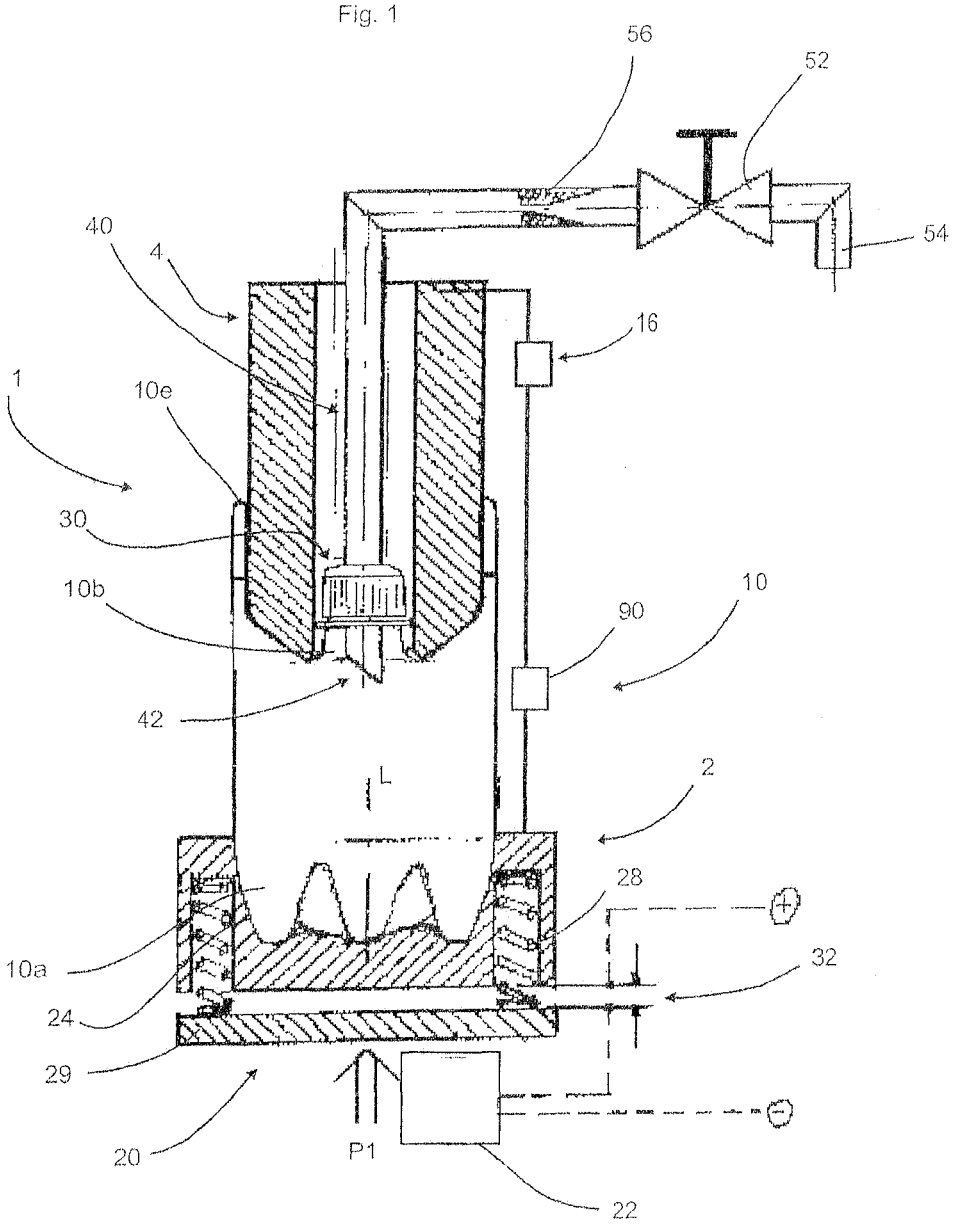
FIG. 1 is a first schematic drawing of a device according to the invention.

FIG. 1 is a drawing of a first embodiment of a device 1 according to the invention. In this context, reference numeral 10 denotes a container to be emptied, this container comprising a base area 10*a* and an opening region 10*b*. Reference numeral 30 denotes a closure of the container, which may in this case be a standard closure. Reference numeral 10*e* denotes an instantaneous fold region at which the container 10 is kinked for discharging liquid. This fold region 10*e* is likewise displaced in the event of a relative movement of the first holding means or device 2 with respect to a second holding means or device 4.

Reference numeral 40 denotes, as a whole, a discharging means for discharging liquid from the container. For this purpose, a valve 52 is provided, optionally along with a throttle body 56, preferably upstream from this valve 52. Reference numeral 54 denotes an outlet for the liquid.

Reference numeral 42 denotes a piercing means which can pierce the container closure 30.

Reference numeral 20 denotes, as a whole, a control means for controlling the discharging of the liquid from the container 10 as a function of the internal pressure thereof. In this context, a drive means or drive device 22 is provided, such as an electric motor in this case, and can move the first holding means 2 upwards, and thus towards the second holding means 4 which is arranged stationary in this case, as indicated by the arrow P1. In this case, the first holding means 2 comprises a receiving means 24 for receiving the base area 10*a*. Springs 28 are further provided, and push the receiving means and a base plate 29 apart.

Reference numeral 32 denotes a switching element or device which can be switched when the receiving means 24 is moved towards the base plate 29. As a function of this switching element, the drive means 22 can be switched on or off. In this way, a two-point control system can be provided in this context, and provides control as a function of a pressure within the container 10, which in this case is exerted as pressure on the holding means 2.

Alternatively or in addition, the drive means 22 may for example be controlled in such a way that it only makes a maximum torque or drive torque possible and remains stationary if this drive torque is exceeded. Once the pressure in the container falls, the motor 22 or the drive means 22 moves the first holding means upwards and thus compresses the container again (causing the internal pressure in the container to rise again). Thus, the discharging of the liquids depends on the internal pressure in the container in this mode of operation too, but a volume-controlled discharging of the liquid takes place more precisely. In this context, it would be possible to provide both pressure-dependent control mechanisms (redundantly), so as to prevent the container 10 from cracking in all cases.

Reference numeral 16 denotes a movement means which serves to pull off the compressed container 10 from the second holding means 4. This movement means may for example be arranged rigidly on the first movable holding means 2. During a rearward movement of the first holding means 2 downwards, this movement means comes into contact with the container 10 and pulls it off from the second holding means 4 at least in part.

Therefore, this movement means 16 is preferably arranged movably, and is preferably coupled to a movement of the first holding means 2 at least at times. It would also be conceivable for the movement of the movement means only to be coupled to the movement of the first holding means 2 during a rearward movement. Preferably, the movement means 16 is positioned on the second holding means 4 or on the outer periphery thereof. However, it would also be conceivable to provide a separate drive for moving the movement means. It would also be conceivable for the movement means to be movable manually. The movement means could also be in the form of a ring which is displaceable with respect to the second holding means.

In the embodiment shown in FIG. 1, the discharging is pressure-controlled.

Reference numeral 90 schematically denotes a readout means for reading out an identification element arranged on the container, which may for example be an RFID chip. However, depending on the position in which this identification element is arranged on the container, the readout means may also be located in a different region of the device 1.

Figure 2:
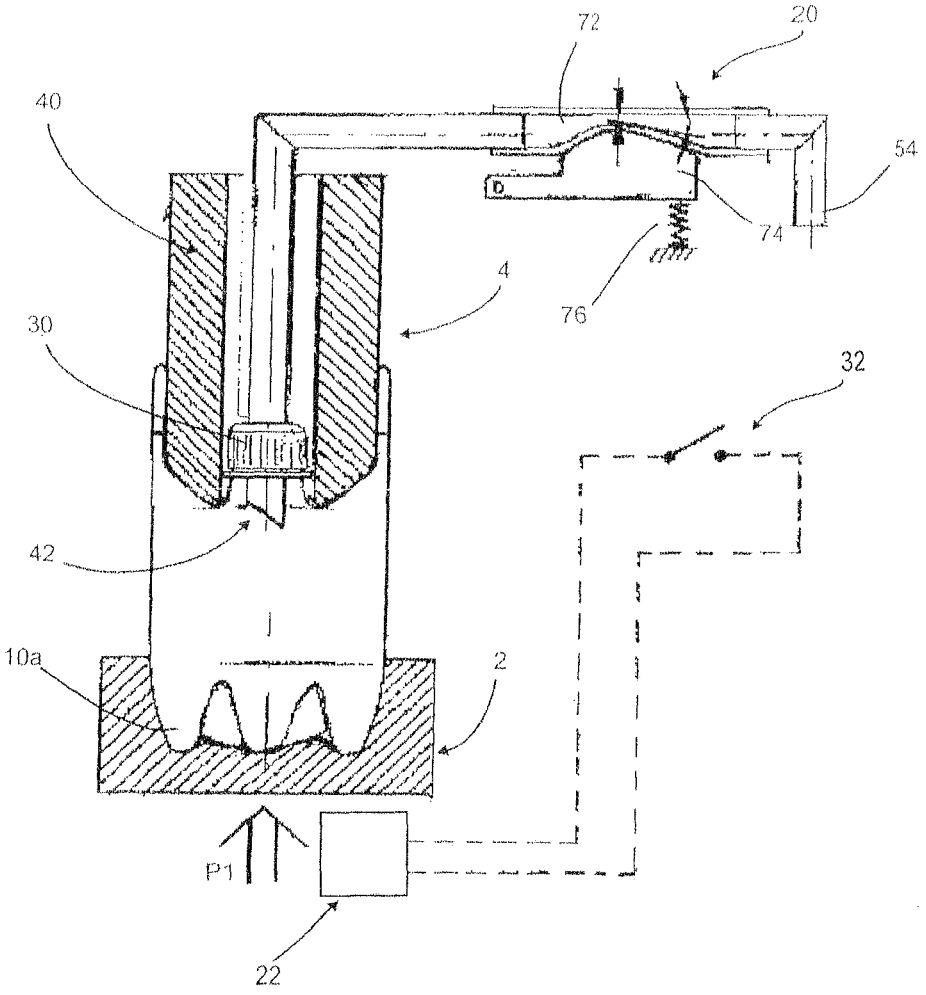
FIG. 2 is a schematic drawing of a second embodiment of a device according to the invention.

FIG. 2 shows a further embodiment of the device according to the invention. In this embodiment, the discharging means 40 comprises a flexible line portion 72, which can be squeezed by a cross-section constriction element 74, which is loaded by a spring 76. In this case, the combination of this flexible line cross-section and the spring-loaded cross-sectional constriction element forms the control means 20, which in this embodiment controls the drawing of the liquid from the container as a function of an internal pressure of the container 10.

If it is desired to discharged liquid, the user activates the drive means, compressing the container and increasing the internal pressure in the container 10. As a result of this increased internal pressure, the pressure in the flexible line portion 72 also increases, the cross-sectional constriction element can open and liquid escapes. As a result, in turn, the internal pressure in the container 10 falls, and as a result of the reduced internal pressure, the cross-sectional constriction element can close the line portion 72 again.

It is advantageous for the spring force acting on the cross-sectional constriction element to be adjustable, so as to adjust the pressure starting from which liquid is emitted.

In addition, or as a further safety means, the motor 33 may also comprise a torque-dependent cut-out means, so as to prevent the container 10 from cracking even if faults occur in the control means 20.

If desired, this cross-sectional constriction element 74 may also be configured so as to be slightly movable by the user, so as to allow liquid to escape via the outlet 54 (by increasing the cross-section of the line portion 72) (even at a relatively low internal pressure in the container).

In this context, reference numeral 42 in turn denotes the piercing body or the piercing means which can pierce the container closure 30. This piercing body is advantageously in the form of a tube through which a liquid can flow.

Figure 3:
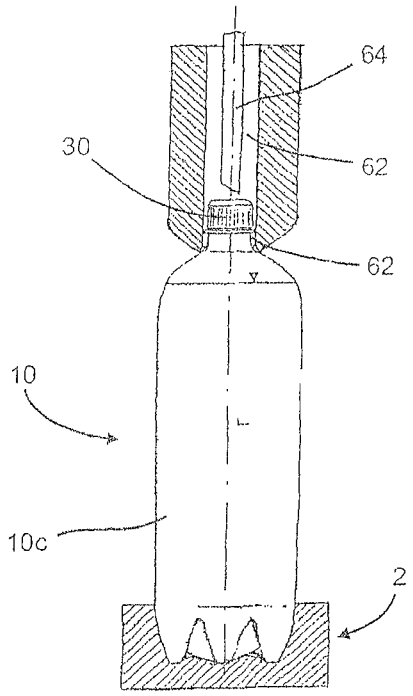
FIG. 3 is a drawing relating to the use of an upright container.

FIG. 3 is a further schematic drawing of a device according to the invention. As can be seen, the container is used upright in this case. The second holding means 4 comprises a cavity or receiving space 62, within which a line 64 for discharging the liquid (but preferably also an opening of the container 10) is arranged. In this context, this line 64 also extends in the longitudinal direction L of the container 10. It can further be seen that no housing, or no wall against which this base body portion 10*c* of the container can be positioned, is formed around a base body 10*c* of the container 10. In the embodiment shown here, the first holding means 2 is adapted to a base structure of the container 10. However, this is not absolutely necessary.

Figure 4:
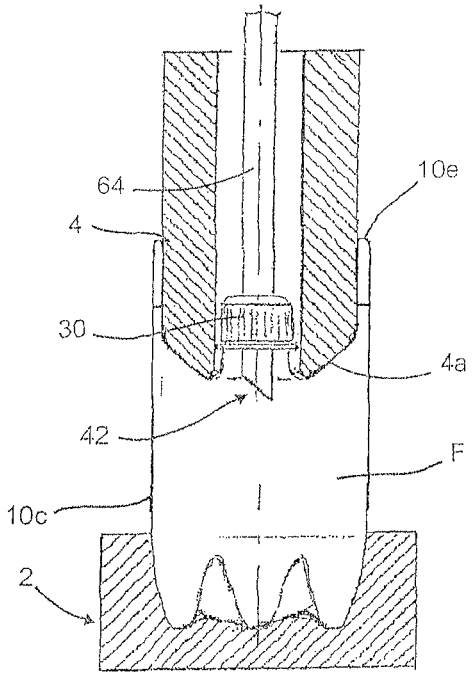
FIG. 4 is a drawing of a partially emptied container.

FIG. 4 shows the device in a partially emptied state of the container. In this context, the puncturing body 42 punctures through the container closure 30 and is subsequently introduced until the entire cross-section of the puncturing body is arranged within the product or the liquid F. In this context, it is possible for the entire holding means 4 or the stamp 3 to move downwards together with a movement of the piercing body 42. However, these two bodies are preferably arranged stationary.

In this context, the container is thus pressed out from the shoulder by a movement of the holding means 2, it particularly preferably being ensured that there is no product, but merely air or a gas, located in the region of the fold 10*e*.

However, as a result of the holding means 4 or the stamp, the opening and also the inner part of the container shoulder remain upright. It can be seen that the holding means 4 receives not only the opening, but also a start region of the shoulder of the container. Accordingly, the holding means is adapted to the region 4*a* of the shoulder shape of the container 10, and after being pressed in the holding means or the stamp is formed in a mirrored shape in such a way that the unwound part of the container shoulder corresponds to the unwound part of the stamp shoulder 4*a*. It would also be possible for the stamp shoulder to change the shoulder of the (during the compression thereof) in favour of better emptying, or else in favour of better mounting. In other words, in an embodiment of this type, the shape of the stamp shoulder deforms the shape of the container shoulder rather than being adapted thereto.

Further, it would be possible for the unwound stamp shoulder to be shortened somewhat, making it easier to pull the outer diameter inwards.

As stated above, the stamp (in other words the holding means 4) and the support shell (the first holding means 2) move with respect to one another.

Preferably, as stated above, the first holding means 2 is moved and pressed against the stationary holding means 4. This has the advantage that the discharging means 40 and also potentially the spigot can be arranged stationary.

Figure 5:
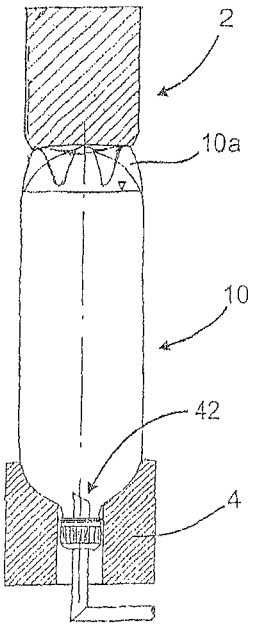
FIG. 5 is a drawing of a container for overhead use.

FIG. 5 shows an embodiment in which the container 10 is used overhead. In this case, it is only necessary for the piercing means 42 to pierce in such a way that a corresponding opening is created so as to empty as much as possible. In this case, the opening of the container is arranged downwards. In this context, a corresponding piercing means may comprise a cutting edge, which does not extend around the entire periphery in the peripheral direction.

In this embodiment, the container base 10*a* is advantageously curled into the container, so as also to have the rim upwards, in such a way that a puddle of product is not produced inside the rim. In this variant, very extensive emptying of the residual product can be achieved. However, there is the drawback that the container can continue to drip after the discharging from the container 10.

Figure 6:
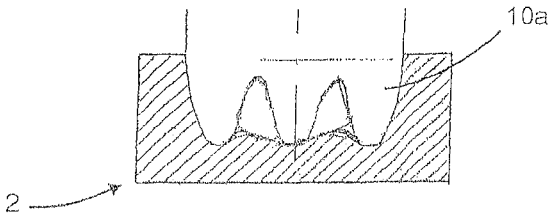
FIG. 6 is a drawing of an embodiment in which the first holding means comprises a receiving element.

FIG. 6 shows an embodiment in which the first holding means 2 comprises a receiving element, the shape of which is adapted to a container base, for example to what is known as a petaloid base. This embodiment has the advantage that the container can be held very stably in the holding means 2.

Figure 7:
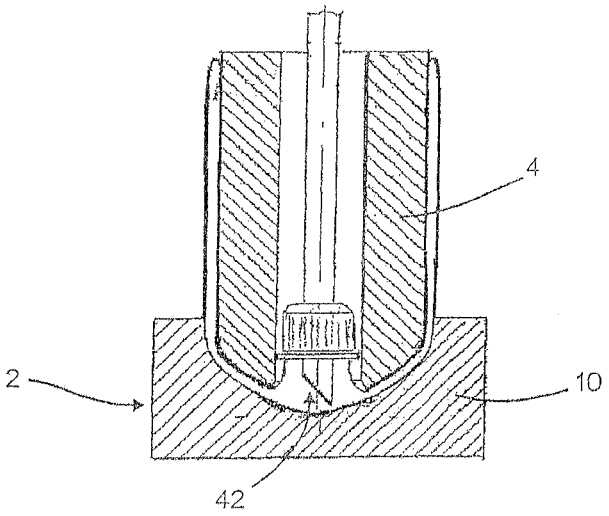
FIG. 7 is a drawing of a further embodiment of a device according to the invention.

FIG. 7 shows a further embodiment of a device according to the invention. In this embodiment, the holding means 2 does not comprise a receiving means which is adapted to the shape of the base of the container. Instead, in this case the container is pressed into a different shape. The container is thus deformed between the first holding means 2 and the second holding means 4, or between the stamp 4 and the shell 2. In this case, the floor and the feet of the container 10 are deformed or crumpled in such a way that as small a cavity as possible is left. The plastics material of the container makes this irregular folding possible. In other words, the axial deformation force, the internal pressure of the container, and in particular mechanical compression bring the base and the feet into a suitable shape so as to empty the container in an optimal manner. However, this requires relatively strong compressive forces from the drive means (and/or considerable gear reduction).

Depending on the configuration of the base of the container, the feet thereof can be pressed in to a greater or lesser degree. The limiting factor is the thick-walled portion in the centre of the base. As a result of the deformation, the shoulder of the container is positioned against (or directly in front of) the base which is deformed in this manner, and this results in a type of annular channel in the centre of the base, where the residual liquid flows towards the centre when the container is unloaded. In this case it is advantageous for the piercing means 42 to project as far as the base of the container.

Figure 8:
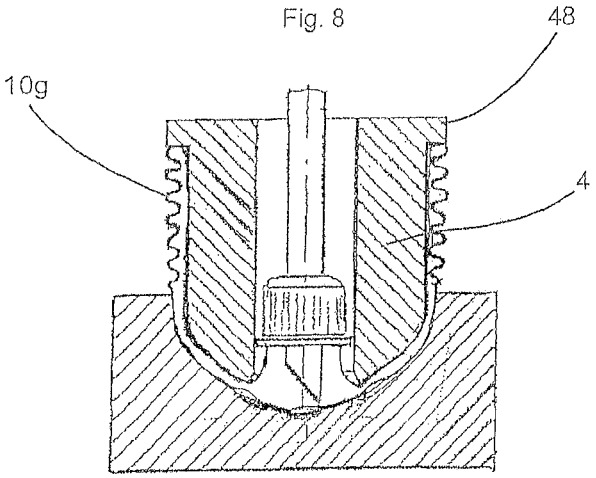
FIG. 8 is a drawing of a further embodiment which additionally brings about a reduction in the overall height of the device.

FIG. 8 shows a further embodiment which additionally brings about a reduction in the overall height of the device. In this embodiment, the second holding means 4 is shorter than half the length of the container, for example in the range of a third of the container length. In addition, radially circumferential projections or a flange 48 may be provided, which mean that not only is the container curled by way of the folds 10*e* shown in the drawings above, but additionally there is also further a constriction in the region 10*g* of the container. In this way, as stated, the stamp length and thus also the overall height can be reduced. More precisely, it is possible to reduce the length of the second holding means 4 in the longitudinal direction L of the container by almost half.

Further, in this way it is possible to reduce the residual volume in the container even further. Further, the liquid can be expelled even further using a casing in the container head space.

When the container 10 is curled in far enough for the deflected container wall to be positioned at the end of the holding means 4 or on the flange 48, one wave or fold after another normally lines up starting from this flange 48. However, it is also unproblematic if the container wall is compressed amorphously.

Figure 9A:
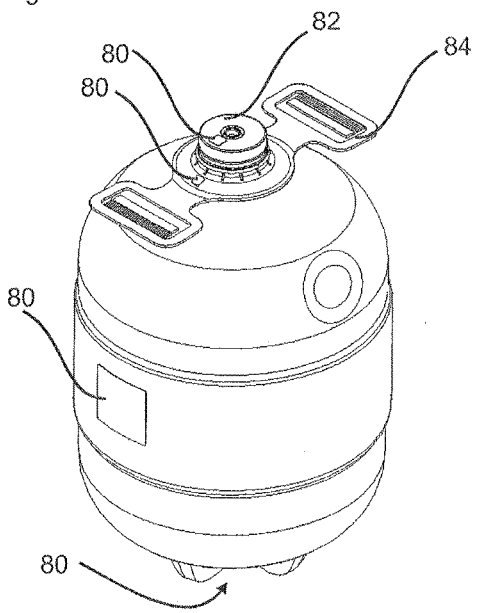

FIGS. 9*a*-9*g* are a plurality of drawings of containers comprising identification elements. The drawing of FIG. 9*a* illustrates in which regions an identification element 80 of this type can be arranged. It may for example be located on or in a closure 82 of the container, on a carrying handle 84 or on a wall region of the container 10 or on a base area of the container 10. It would also be conceivable to provide a plurality of identification elements of this type, which may in particular by RFD chips.

Figure 9B:
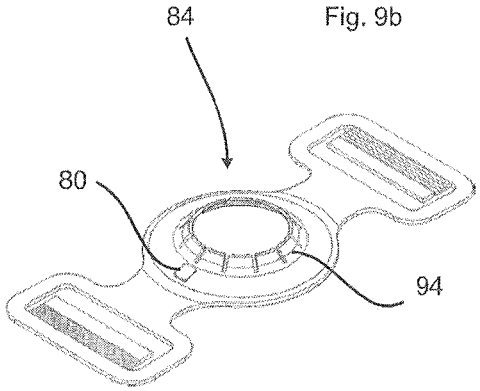

FIG. 9*b* is a drawing in which the identification element 80 is arranged on a carrying handle. This handle 84 can be snapped open onto the container over an opening of the container by means of a snap-on means 94. The identification element 80 may for example be integrated into or glued onto the carrying handle 84. Because of the snap-on means, the carrying handle 84 is advantageously arranged permanently on the container, again meaning that the identification element 80 is fixed to the container. Alternatively, the carrying handle may be removable or only removable with difficulty.

Figure 9C:
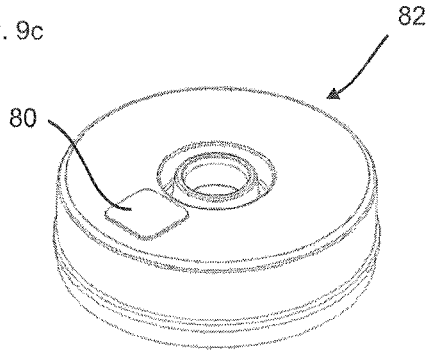

FIG. 9*c* is a drawing in which the identification element is arranged on a closure 82 of the container 10. In this case too, the identification element may be integrated into this closure or else for example be glued on.

Figure 9D:
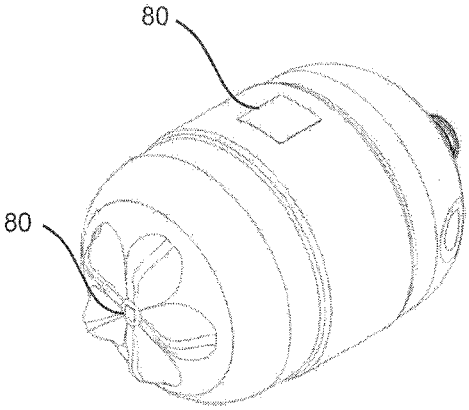

FIG. 9*d* is a drawing in which the identification element 80 is arranged on a base or on a peripheral wall of the container. In this case too, the identification element may be introduced or integrated. In particular for an arrangement on the wall, the identification element may also be integrated into a label attached to the container. In this embodiment, the identification element is advantageously arranged in a position on the container which is not in the region of the peripheral fold edge during the discharging process.

Aside from the use of RFID chips, other identification elements could also be used, such as in particular bar codes or QR codes. These could for example also be pressed onto a wall of the container.

FIG. 9*e* shows a further possible arrangement of an identification element 80. In this case, the identification element is arranged on a carrying ring which is located in an opening region of the container 10. FIG. 9*f* is a more detailed drawing of this. In this context, the identification element also comprises an antenna 81 which in this case extends around the opening 10*b* of the container 10.

FIG. 9*g* is a discharging illustrating reading out an identification element 80. In this case, this identification element 80 is arranged on a peripheral wall of the container. In this case, this device for discharging liquid comprises an annular readout means 90 for reading out the identification element. This has the advantage that the container does not have to be arranged in the correct rotational position in the discharging means (40). Conversely, however, it may also actually be desired for the identification element only to be readable in a precisely defined rotational position. In this case, the identification element may also be used so as to ensure an arrangement of the container in the correct rotational position in the discharging means (40).

The Applicant reserves the right to claim all of the features disclosed in the application documents as essential to the invention wherever they are novel over the prior art individually or in combination.

LIST OF REFERENCE NUMERALS

1 Device
2 First holding means
4 Second holding means
4*a* Stamp shoulder
10 Container
10*a* Base area
10*b* Opening region
10*c* Base body
10*e* Fold region
10*g* Constricted region
16 Movement element
20 Control means
22 Drive means
24 Receiving means
28 Spring
29 Base plate
30 Container closure
32 Switching element
40 Discharging means
42 Piercing means
48 Flange
52 Valve
54 Outlet
56 Throttle body
62 Receiving space
64 Line
72 Flexible line portion
74 Cross-sectional constriction element
76 Spring
80 Identification element
81 Antenna
82 Closure
84 Handle

90 Readout means
94 Snap-on means
$P_1$ Upward movement of the first holding means
L Longitudinal direction of the container
F Liquid

The invention claimed is:

1. An apparatus for discharging liquids from a deformable container having a top portion spaced in a longitudinal direction from a base, wherein a distance between the base and the top portion of the container is significantly greater than the diameter of the base, the apparatus comprising:

a first holding device shaped for holding the base of the container, wherein the first holding device is spring loaded on a base plate, and extends on an outside and sideways in the longitudinal direction of the container a length less than half a length of the container;

a second holding device spaced from the first holding device for holding the top portion of the container, wherein the first and second holding devices are arranged to accommodate the container at least in part between the first and second holding devices;

an electric motor for moving the first holding device towards the second holding device, so as to reduce the space between the first folding device and the second holding device whereby to deform the container arranged between the first and second holding devices whereby to reduce an internal volume thereof;

a discharging device, which comprises a flow connection to an interior of the container, and through which liquid located in the container can be discharged by compressing the container; and a control device which controls relative movement of one holding device with respect to the other holding device or the drawing of the liquid through the drawing device as a function of an internal pressure within the container wherein the one and the other holding devices move in a straight line and in the longitudinal direction of the container with respect to one another, and wherein the discharging device comprises a piercing device for penetrating at least one wall of the container or a container closure of the container.

2. The apparatus according to claim 1, wherein the top portion is an opening region of the container and the second holding device serves to hold the opening region of the container.

3. The apparatus according to claim 1, wherein the first holding device and the second holding device are arranged to accommodate the container upright with the opening pointing upwards.

4. The apparatus according to claim 1, wherein at least one holding device comprises a stamp element, which is of a smaller cross-section than a base body of the container.

5. The apparatus according to claim 4, wherein the holding device which serves to hold the opening region of the container comprises a stamp element which is of a smaller cross-section than a base body of the container.

6. The apparatus according to claim 1, wherein the control device comprises an electronic switch which switches the drive device on or off as a function of a pressure within the container.

7. The apparatus according to claim 1, wherein the discharging device is integrated into a holding device.

8. The apparatus according to claim 1, wherein the apparatus further comprises a readout device for reading out at least one identification element attached to the container.

9. The apparatus according to claim 8, wherein the readout device comprises a wireless readout device.

10. The apparatus according to claim 1, wherein the discharge device comprises a flexible line which is acted on by a spring-loaded constriction element.

11. The apparatus according to claim 10, wherein the spring-loaded constriction element controls discharge of liquid as a function of an internal pressure of the container.

12. The apparatus according to claim 11, wherein the spring-loaded constriction element is adjustable so as to adjust a threshold pressure at which liquid will be discharged from the container.

* * * * *